US008534797B2

(12) United States Patent
Zhao et al.

(10) Patent No.: US 8,534,797 B2
(45) **Date of Patent: *Sep. 17, 2013**

(54) SUPEROLEOPHOBIC AND SUPERHYDROPHOBIC DEVICES AND METHOD FOR PREPARING SAME

(75) Inventors: Hong Zhao, Webster, NY (US); Kock-Yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 664 days.

This patent is subject to a terminal disclaimer.

(21) Appl. No.: 12/647,945

(22) Filed: Dec. 28, 2009

(65) Prior Publication Data

US 2011/0157276 A1 Jun. 30, 2011

(51) Int. Cl.
*B41J 2/14* (2006.01)

(52) U.S. Cl.
USPC ..... 347/47

(58) Field of Classification Search
USPC ..... 347/47, 40, 43; 427/466
See application file for complete search history.

(56) References Cited

U.S. PATENT DOCUMENTS

| | | | | |
|---|---|---|---|---|
| 4,719,480 | A * | 1/1988 | Elrod et al. | 347/46 |
| 4,889,560 | A | 12/1989 | Jaeger et al. | |
| 4,889,761 | A | 12/1989 | Titterington et al. | |
| 5,121,141 | A * | 6/1992 | Hadimoglu et al. | 347/46 |
| 5,221,335 | A | 6/1993 | Williams et al. | |
| 5,230,926 | A | 7/1993 | Narang et al. | |
| 5,372,852 | A | 12/1994 | Titterington et al. | |
| 5,432,539 | A | 7/1995 | Anderson | |
| 5,621,022 | A | 4/1997 | Jaeger et al. | |
| 5,867,189 | A | 2/1999 | Whitlow et al. | |
| 6,284,377 | B1 | 9/2001 | Veerasamy | |
| 6,648,470 | B2 * | 11/2003 | Korem | 347/106 |
| 6,737,109 | B2 | 5/2004 | Stanton et al. | |
| 6,775,502 | B1 | 8/2004 | Domoto et al. | |
| 7,259,275 | B2 | 8/2007 | Belelie et al. | |
| 7,271,284 | B2 | 9/2007 | Toma et al. | |
| 7,276,614 | B2 | 10/2007 | Toma et al. | |
| 7,279,587 | B2 | 10/2007 | Odell et al. | |
| 2005/0206705 | A1 | 9/2005 | Ma et al. | |
| 2006/0078724 | A1 | 4/2006 | Bhushan et al. | |
| 2007/0120910 | A1 | 5/2007 | Odell et al. | |
| 2007/0123606 | A1 | 5/2007 | Toma et al. | |
| 2008/0225082 | A1 | 9/2008 | McAvoy et al. | |
| 2008/0316247 | A1 | 12/2008 | Cellura et al. | |
| 2009/0046125 | A1 | 2/2009 | Nystrom et al. | |
| 2009/0141110 | A1 | 6/2009 | Gervasi et al. | |
| 2009/0142112 | A1 | 6/2009 | Gervasi et al. | |

OTHER PUBLICATIONS

U.S. Patent Application filed Dec. 28, 2009, of Varun Sambhy et al., entitled "Image Conditioning Coating" 26 pages, 4 drawing sheets, U.S. Appl. No. 12/625,472, not yet published.

(Continued)

*Primary Examiner* — Lamson Nguyen
(74) *Attorney, Agent, or Firm* — Marylou J. Lavoie

(57) ABSTRACT

A process for preparing a flexible device having a textured superoleophobic surface comprising providing a flexible substrate; disposing a silicon layer on the flexible substrate; using photolithography to create a textured pattern in the silicon layer on the substrate wherein the textured pattern comprises an array of pillars; and chemically modifying the textured surface by disposing a conformal oleophobic coating thereon; to provide a flexible device having a superoleophobic surface and, in embodiments, to provide a flexible device having a surface that is both superoleophobic and superhydrophobic.

19 Claims, 6 Drawing Sheets

(56) References Cited

OTHER PUBLICATIONS

U.S. Patent Application filed Aug. 19, 2009, of David J. Gervasi et al., entitled "Polyhedral Oligomeric Silsesquioxane Image Conditioning Coating" 39 pages, 4 drawing sheets, U.S. Appl. No. 12/544,031, not yet published.
U.S. Patent Application filed Dec. 9, 2008, of Steven E. Ready et al., entitled "Spreading and Leveling of Curable Gel Ink" 13 pages, 4 drawing sheets, U.S. Appl. No. 12/331,076, not yet published.
Rios et al., "The Effect of Polymer Surface on the Wetting and Adhesion of Liquid Systems," J. Adhesion Sci. Technol., vol. 21, No. 3-4, pp. 227-241 (2007).
Zisman, "Relation of the Equilibrium Contact Angle to Liquid and Solid Constitution," Advances in Chemistry Series, (1964), 43, 1-51.
Ahuja et al., "Nanonails: A Simple Geometrical Approach to Electrically Tunable Superlyophobic Surfaces," Langmuir, vol. 24, No. 1, 2008, Published on Web Oct. 12, 2007, pp. 9-14.
U.S. Patent Application filed Nov. 24, 2009, of Gregory J. Kovacs et al., entitled "Coating for an Ink Jet Printhead Front Face" 26 pages, 6 drawing sheets, U.S. Appl. No. 12/625,442, not yet published.
U.S. Patent Application filed Dec. 28, 2009, of Hong Zhao et al., entitled "Superoleophobic and Superhydrophobic Devices and Method for Preparing Same" 24 pages, 6 drawing sheets, U.S. Appl. No. 12/647,945, not yet published.
U.S. Patent Application filed Dec. 28, 2009, of Hong Zhao et al., entitled "A Process for Preparing an Ink Jet Print Head Front Face Having a Textured Superoleophobic Surface" 28 pages, 9 drawing sheets, U.S. Appl. No. 12/648,004, not yet published.
U.S. Patent Application filed Dec. 28, 2009, of Hong Zhao et al., entitled "Superoleophobic and Superhydrophobic Surfaces and Method for Preparing Same" 23 pages, 4 drawing sheets, U.S. Appl. No. 12/647,977, not yet published.
Koene et al., "Ultrahydrophobic Coatings," Smart Coatings Proceeding, Feb. 27-29, 2008, 40 pages.
Jun et al., "Direct-current substrate bias effects on amorphous silicon sputter-deposited films for thin film transistor fabrication," Applied Physics Letters, 87, 132108 (2005), 3 pages.
Kwon et al., "Low Temperature Thin Film Poly-Si Thin Film Transistor on Plastic Substrates," IEICE Trans. Electron, vol. E88-C, No. 4, Apr. 2005, 5 pages.
Bae et al., "Characteristics of Amorphous and Polysilicon Films Deposited at 120° C. by Electron Cyclotron Resonance Plasma-Enhanced Chemical Vapor Deposition," J. Vac. Sci. Technol. A 16(3), May/Jun. 1998, 5 pages.
Tenhaeff et al., "Initiated and Oxidative Chemical Vapor Deposition of Polymeric Thin Films: iCVD and oCVD," Adv. Func. Mater. 2008, 18, pp. 979-992.
Neinhuis et al., "Characterization and Distribution of Water-Repellant, Self-Cleaning Plant Surfaces," Annals of Botany 79: 1997, pp. 667-677.
Artus et al., "Silicone Nanofilaments and Their Application As Superhydrophobic Coatings," Adv. Mater. 2006, 18, pp. 2758-2762.
Choi et al., "Fabrics With Tunable Oleophobicity," Adv. Mater. 2009, 21, pp. 2190-2195.
Feng et al., "Super-Hydrophobic Surfaces: From Natural to Artificial," Adv. Mater. 2002, !4, pp. 1857-1860.
Robert N. Wenzel, "Resistance of Solid Surfaces to Wetting by Water," Industrial and Engineering Chemistry, vol. 28, No. 8, Aug. 1936, pp. 988-994.
Tillman et el., "Incorporation of Phenoxy Groups in Self-Assembled Monolayers of Trichlorosilane Derivatives: Effects on Film Thickness, Wettability, and Molecular Orientation," J. Am. Chem. Soc. 1988, 110, pp. 6136-6144.
Zhang et al., "Superhydrophobic Surfaces: from structural control to functional application," J. Mater. Chem., 2008, 18, pp. 621-633.
Parikh et al., "An Intrinsic Relationship Between Molecular Structure in Self-Assembled n-Alkylsiloxane Monolayers and Deposition Temperature," J. Phys. Chem. 1994, 98, pp. 7577-7590.
Robert N. Wenzel, "Communication to the Editor, Surface Roughness and Contact Angle," J. Phys. Colloid Chem., Oct. 25, 1949, pp. 1466-1467.
M. Morra et al., Contact Angle Hysteresis in Oxygen Plasma Treated Poly(tretrafluoroethylene), Langmuir, vol. 5, No. 3, 1989, pp. 872-876.
Öner et al., "Ultrahydrophobic Surfaces. Effect of Topography Length Scales on Wettability," Langmuir, vol. 16, No. 20, 2000, pp. 7777-7782.
Fürstner et al., "Wetting and Self-Cleaning Properties of Artificial Superhydrophobic Surfaces," Langmuir, vol. 21, No. 3, 2005, pp. 956-961.
Abraham Marmur, "Wetting on Hydrophobic Rough Surfaces: to Be Heterogeneous or Not to Be," Langmuir, vol. 19, No. 20, 2003, pp. 8343-8348.
Sun et al., "Artificial Lotus Leaf by Nanocasting," Langmuir, vol. 19, No. 19, 2005, pp. 8978-8981.
Puukilainen et al., "Superhydrophobic Polyolefin Surfaces: Controlled Micro- and Nanostructures," Langmuir, vol. 23, No. 13, 2007, pp. 7263-7268.
Lai et al., "Markedly Controllable Adhesion of Superhydrophobic Spongelike Nanostructure $TiO_2$ Films," Langmuir, vol. 24, No. 8, 2008, pp. 3867-3873.
Reyssat et al., "Contact Angle Hysteresis Generated by Strong Dilute Defects," J. Phys. Chem., vol. 113, No. 12, 2009, pp. 3906-3909.
Tuteja et al., "Robust omniphobic surfaces," PNAS, vol. 105, No. 47, Nov. 25, 2008, pp. 18200-18205.
Tuteja et al., "Design Parameters for Superhydrophobicity and Superoleophobicity," MRS Bulletin, vol. 33, Aug. 2008, pp. 752-758.
Tuteja et al., "Designing Superoleophobic Surfaces," Science, vol. 318, Dec. 7, 2007, pp. 1618-1622.
Lau et al., "Superhydrophobic Carbon Nanotube Forests," Nano Letters, vol. 3, No. 12, 2003, pp. 1701-1705.
Zhai et al, "Stable Superhydrophobic Coatings From Polyelectrolyte Multilayers," Nano Letters, vol. 4, No. 7, 2004, pp. 1349-1353.
Martines et al, "Superhydrophobicity and Superhydrophilicity of Regular Nanopatterns," Nano Letters, vol. 5, No. 10, 2005, pp. 2097-2103.
Cheng et al., "Effects of micro- and nano-structures on the self-cleaning behavior of lotus leaves," Nanotechnology, 17, 2006, pp. 1359-1362.
Wang et al., "Microscale and nanoscale hierarchical structured mesh films with superhydrophobic and superoleophilic properties induced by long-chain fatty acids," Nanotechnology, 18, 2007, 5 pages.
Kobrin et al., "Durable Anti-Stiction Coatings by Molecular Vapor Deposition (MVD)," NSTI-Nanotech 2005, vol. 2, pp. 347-350.
Barthlott et al., "Purity of the sacred lotus, or escape from contamination in biological surfaces," Planta, 1997, pp. 1-8.
Erbil et al., "Transformation of a Simple Plastic Into a Superhydrophobic Surface," Science, vol. 299, Feb. 28, 2003, pp. 1377-1380.
Roach et al., "Progress in superhydrophobic surface development," Soft Matter, 2008, 4, pp. 224-240.
Martin et al., "Initiated Chemical Vapor Depostion (iCVD) of Polymeric Nanocoatings," Surface and Coatings Technology 201, 2007, pp. 9400-9405.
Cassie and Baxter, "Wettability of Porous Surfaces," Trans. Faraday Society, Jun. 19, 1944, 6 pages.
Boreyko et al., "Abstract: EG.00004: Vibration-induced Wenzel to Cassie Transition on a Superhydrophobic Surface," http://meetings.aps.org/link/BAPS.2008.DFD.EG.4, 1 page.

* cited by examiner

SUPEROLEOPHOBIC AND SUPERHYDROPHOBIC DEVICES AND METHOD FOR PREPARING SAME

TECHNICAL FIELD

Described herein are flexible materials having superoleophobic surfaces and a method for preparing same. More particularly, described herein are superoleophobic devices, in embodiments, films, and in further embodiments, films that are both superoleophobic and superhydrophobic, comprising a textured silicon layer comprising an array of pillars and a conformal oleophobic coating disposed on the textured silicon layer, and methods for preparing same.

RELATED APPLICATIONS

Commonly assigned U.S. patent application Ser. No. 12/647,977, entitled "Superoleophobic Surfaces and Method For Preparing Same," filed concurrently herewith, which is hereby incorporated by reference herein in its entirety, describes a process for preparing a flexible device having a superoleophobic surface comprising providing a flexible substrate; disposing a silicon layer on the flexible substrate; using photolithography to create a textured pattern in the silicon layer on the substrate wherein the textured pattern comprises a groove structure; and chemically modifying the textured surface by disposing a conformal oleophobic coating thereon; to provide a flexible device having a superoleophobic surface.

Commonly assigned U.S. patent application Ser. No. 12/648,004, entitled "A Process For Preparing An Ink Jet Print Head Front Face Having A Textured Superoleophobic Surface," filed concurrently herewith, which is hereby incorporated by reference herein in its entirety, describes a process for preparing an ink jet print head front face or nozzle plate having a textured superoleophobic surface comprising providing a silicon substrate; using photolithography to create a textured pattern in the silicon substrate; optionally, modifying the textured silicon surface by disposing a conformal oleophobic coating thereon; and forming an ink jet print head front face or nozzle plate from the textured oleophobic silicon material to provide an ink jet print head front face or nozzle plate having a textured superoleophobic surface.

BACKGROUND

Disclosed herein is a process for preparing a flexible device having a superoleophobic surface comprising providing a flexible substrate; disposing a conformal, oleophobic layer on a flexible substrate; using photolithography to create a textured pattern on the substrate wherein the textured pattern comprises an array of pillars; and chemically modifying the textured surface by disposing a fluorosilane coating thereon; to provide a flexible device having a superoleophobic surface. In specific embodiments, the flexible, superoleophobic device can be used as a front face surface for an ink jet printhead.

Fluid ink jet systems typically include one or more printheads having a plurality of ink jets from which drops of fluid are ejected towards a recording medium. The ink jets of a printhead receive ink from an ink supply chamber or manifold in the printhead which, in turn, receives ink from a source, such as a melted ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to one another, the deposited drops can be precisely patterned to form particular text and graphic images on the recording medium. An example of a full width array printhead is described in U.S. Patent Publication 20090046125, which is hereby incorporated by reference herein in its entirety. An example of an ultra-violet curable gel ink which can be jetted in such a printhead is described in U.S. Patent Publication 20070123606, which is hereby incorporated by reference herein in its entirety. An example of a solid ink which can be jetted in such a printhead is the Xerox Color Qube™ cyan solid ink available from Xerox Corporation. U.S. Pat. No. 5,867,189, which is hereby incorporated by reference herein in its entirety, describes an ink jet print head including an ink ejecting component which incorporates an electropolished ink-contacting or orifice surface on the outlet side of the printhead.

One difficulty faced by fluid ink jet systems is wetting, drooling or flooding of inks onto the printhead front face. Such contamination of the printhead front face can cause or contribute to blocking of the ink jet nozzles and channels, which alone or in combination with the wetted, contaminated front face, can cause or contribute to non-firing or missing drops, undersized or otherwise wrong-sized drops, satellites, or misdirected drops on the recording medium and thus result in degraded print quality. Current printhead front face coatings are typically sputtered polytetrafluoroethylene coatings. When the printhead is tilted, the UV gel ink at a temperature of about 75° C. (75° C. being a typical jetting temperature for UV gel ink) and the solid ink at a temperature of about 105° C. (105° C. being a typical jetting temperature for solid ink) do not readily slide on the printhead front face surface. Rather, these inks flow along the printhead front face and leave an ink film or residue on the printhead which can interfere with jetting. For this reason, the front faces of UV and solid ink printheads are prone to be contaminated by UV and solid inks. In some cases, the contaminated printhead can be refreshed or cleaned with a maintenance unit. However, such an approach introduces system complexity, hardware cost, and sometimes reliability issues.

There remains a need for materials and methods for preparing devices having superoleophobic characteristics alone or in combination with superhydrophobic characteristics. Further, while currently available coatings for ink jet printhead front faces are suitable for their intended purposes, a need remains for an improved printhead front face design that reduces or eliminates wetting, drooling, flooding, or contamination of UV or solid ink over the printhead front face. There further remains a need for an improved printhead front face design that is ink phobic, that is, oleophobic, and robust to withstand maintenance procedures such as wiping of the printhead front face. There further remains a need for an improved printhead front face design that is superoleophobic and, in embodiments, that is both superoleophobic and superhydrophobic. There further remains a need for an improved printhead that is easily cleaned or that is self-cleaning, thereby eliminating hardware complexity, such as the need for a maintenance unit, reducing run cost and improving system reliability.

The appropriate components and process aspects of the each of the foregoing U.S. patents and patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a process for preparing a flexible device having a superoleophobic surface comprising providing a flexible substrate; disposing a silicon layer on the flexible substrate; using photolithography to create a textured pattern in the silicon layer on the substrate wherein the textured pattern comprises an array of pillars; and chemically modifying the textured surface by disposing a conformal, oleophobic coating thereon; to provide a flexible device having a superoleophobic surface.

Also described is a flexible device having a superoleophobic surface comprising a flexible substrate comprising a plastic film; a silicon layer disposed on the flexible substrate wherein the silicon layer comprises a textured pattern comprising an array of pillars; and a conformal, oleophobic coating disposed on the textured surface.

Further described is an ink jet printhead comprising a front face comprising a flexible substrate comprising a plastic film; a silicon layer disposed on the flexible substrate wherein the silicon layer comprises a textured pattern comprising an array of pillars; and a conformal oleophobic coating, in embodiments a fluorosilane coating, disposed on the textured surface.

DETAILED DESCRIPTION

Described is a process for preparing a flexible device having a highly oleophobic surface, or a superoleophobic surface, comprising providing a flexible substrate; disposing a silicon layer on the flexible substrate; using photolithography to create a textured pattern on the substrate wherein the textured pattern comprises an array of pillars; and chemically modifying the textured surface by disposing a conformal, oleophobic coating thereon; to provide a flexible device having a highly oleophobic surface, or a superoleophobic surface, and, in embodiments, to provide a flexible device having a surface that is both superoleophobic and superhydrophobic.

Highly oleophobic as used herein can be described as when a droplet of hydrocarbon-based liquid, for example, hexadecane or ink, forms a high contact angle with a surface, such as a contact angle of from about 130° or greater than about 130° to about 175° or from about 135° to about 170°. Superoleophobic as used herein can be described as when a droplet of hydrocarbon-based liquid, for example, ink, forms a high contact-angle with a surface, such as a contact angle that is greater than 150°, or from greater than about 150° to about 175°, or from greater than about 150° to about 160°.

Superoleophobic as used herein can also be described as when a droplet of a hydrocarbon-based liquid, for example, hexadecane, forms a sliding angle with a surface of from about 1° to less than about 30°, or from about 1° to less than about 25°, or a sliding angle of less than about 25°, or a sliding angle of less than about 15°, or a sliding angle of less than about 10°.

Highly hydrophobic as used herein can be described as when a droplet of water forms a high contact angle with a surface, such as a contact angle of from about 130° to about 180°. Superhydrophobic as used herein can be described as when a droplet of water forms a high contact angle with a surface, such as a contact angle of greater than about 150°, or from greater about 150° to about 180°.

Superhydrophobic as used herein can be described as when a droplet of water forms a sliding angle with a surface, such as a sliding angle of from about 1° to less than about 30°, or from about 1° to about 25°, or a sliding angle of less than about 15°, or a sliding angle of less than about 10°.

Figure 1:
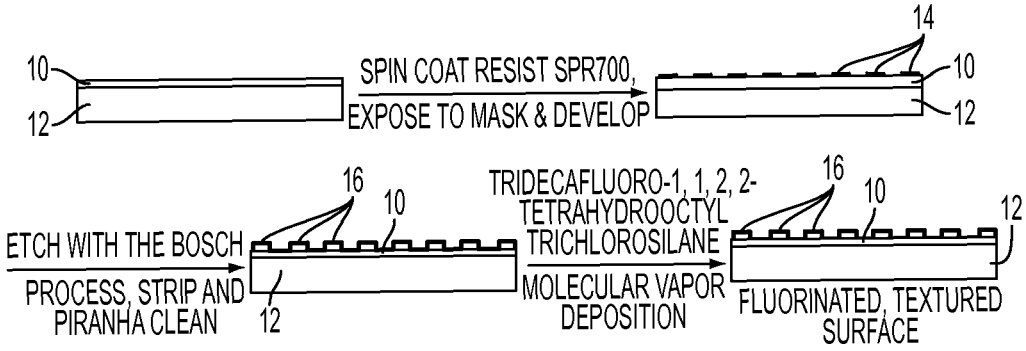
FIG. 1 is an illustration of a process scheme for preparing a fluorinated, textured surface on a flexible substrate wherein the textured surface comprises an array of pillars having wavy side walls in accordance with the present disclosure.

The flexible materials having superoleophobic surfaces herein can be prepared by any suitable method. Referring to FIG. 1, in embodiments, the flexible device having superoleophobic surfaces herein can be prepared by depositing a thin layer of silicon, such as by sputtering, amorphous silicon 10 onto large areas of a flexible substrate 12. The thin layer of silicon can be any suitable thickness. In embodiments, the silicon layer can be deposited onto the flexible substrate at a thickness of from about 500 to about 5,000 nanometers, or about 3,000 nanometers. In further embodiments, wherein the silicon layer comprises amorphous silicon disposed at a thickness of from about 1 to about 5 micrometers.

Any suitable material can be selected for the flexible substrate herein. In embodiments, the flexible substrate can be a plastic film. In specific embodiments, the flexible substrate can be selected from the group consisting of polyimide film, polyethylene naphthalate film, polyethylene terephthalate film, polyethersulfone film, or polyetherimide film, and the like, or a combination thereof, although not limited.

The flexible substrate can be any suitable thickness. In embodiments, the substrate is a plastic film having a thickness of from about 5 micrometers to about 100 micrometers, or from about 10 micrometers to about 50 micrometers.

The silicon layer 10 can be deposited onto the flexible substrate 12 by any suitable method. In embodiments, a silicon thin film is deposited using sputtering or chemical vapor deposition, very high frequency plasma-enhanced chemical vapor deposition, microwave plasma-enhanced chemical vapor deposition, plasma-enhanced chemical vapor deposition, use of ultrasonic nozzles in an in-line process, among others.

Textured patterns comprising an array of pillars can be provided on the flexible substrate. The array of pillar can be defined as an array of pillars having textured or wavy patterned vertical side walls, having an overhang re-entrant structure defined on the top of the pillars, or a combination thereof. Textured or wavy side walls as used herein can mean roughness on the sidewall which is manifested in the submicron range. In embodiments, the wavy side walls can have a 250 nanometer wavy structure with each wave corresponding to an etching cycle as described herein below Textured patterns comprising an array of pillars can be created on the silicon coated substrate using photolithography techniques. For example, the silicon layer 10 on the flexible substrate 12 can be prepared and cleaned in accordance with known photolithographic methods. A photo resist 14 can then be applied, such as by spin coating or slot die coating the photo resist material 14 onto the silicon layer 10. Any suitable photo resist can be selected. In embodiments, the photo resist can be Mega™Posit™ SPR™ 700 photo resist available from Rohm and Haas.

The photo resist 14 can then be exposed and developed according to methods as known in the art, typically by exposure to ultraviolet light and exposure to an organic developer such as a sodium hydroxide containing developer or a metal-ion free developer such as tetramethylammonium hydroxide.

A textured pattern comprising an array of pillars 16 can be etched by any suitable method as known in the art. Generally, etching can comprise using a liquid or plasma chemical agent to remove layers of the silicon that are not protected by the mask 14. In embodiments, deep reactive ion etching techniques can be employed to produce the pillar arrays 16.

After the etching process, the photo resist can be removed by any suitable method. For example, the photo resist can be removed by using a liquid resist stripper or a plasma-containing oxygen. In embodiments, the photo resist can be stripped using an $O_2$ plasma treatment such as the GaSonics Aura 1000 ashing system available from Surplus Process Equipment Corporation, Santa Clara, Calif. Following stripping, the substrate can be cleaned, such as with a hot piranha cleaning process.

After the surface texture is created on the flexible substrate, the surface texture can be chemically modified. Chemically modifying the textured substrate as used herein can comprise any suitable chemical treatment of the substrate, such as to provide or enhance the oleophobic quality of the textured surface. In embodiments, chemically modifying the textured substrate surface comprises disposing a self assembled layer consisting of perfluorinated alkyl chains onto the textured silicon surface. A variety of technology, such as the molecular vapor deposition technique, the chemical vapor deposition technique, or the solution coating technique can be used to deposit the self assembled layer of perfluorinated alkyl chains onto the textured silicon surface. In embodiments, chemically modifying the textured substrate comprises chemical modification by self-assembling a fluorosilane coating onto the textured surface conformally via a molecular vapor deposition technique, a chemical vapor deposition technique, or a solution self assembly technique. In a specific embodiment, chemically modifying the textured substrate comprises disposing layers assembled by tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof, and the like, using the molecular vapor deposition technique or the solution coating technique.

In a specific embodiment, the Bosch deep reactive ion etching process comprising pulsed or time-multiplexed etching is employed to create the textured surface comprising arrays of pillars. The Bosch process can comprise using multiple etching cycles with three separate steps within one cycle to create a vertical etch: 1) deposition of a protective passivation layer, 2) Etch 1, an etching cycle to remove the passivation layer where desired, such as at the bottom of the valley, and 3) Etch 2, an etching cycle to etch the silicon isotropically. Each step lasts for several seconds. The passivation layer is created by $C_4F_8$ which is similar to Teflon® and protects the entire substrate from further chemical attack and prevents further etching. However, during the Etch 1 phase, the directional ions that bombard the substrate attack the passivation layer at the bottom of the valley (but not along the pillar side walls). The ions collide with the passivation layer and sputter it off, exposing the bottom of the valley on the substrate to the chemical etchant during Etch 2. Etch 2 serves to etch the silicon isotropically for a short time (for example, from about 5 to about 10 seconds). A shorter Etch 2 step gives a smaller wave period (5 seconds leads to about 250 nanometers) and a longer Etch 2 yields longer wave period (10 seconds leads to about 880 nanometers). This etching cycle can be repeated until a desirable pillar height is obtained. In this process, pillars can be created having a textured or wavy sidewall wherein each wave corresponds to one etching cycle.

The size of the periodic "wave" structure can be any suitable size. In specific embodiments herein, the size of each "wave" of the wavy sidewall is from about 100 nanometers to about 1,000 nanometers, or about 250 nanometers.

Figure 2:
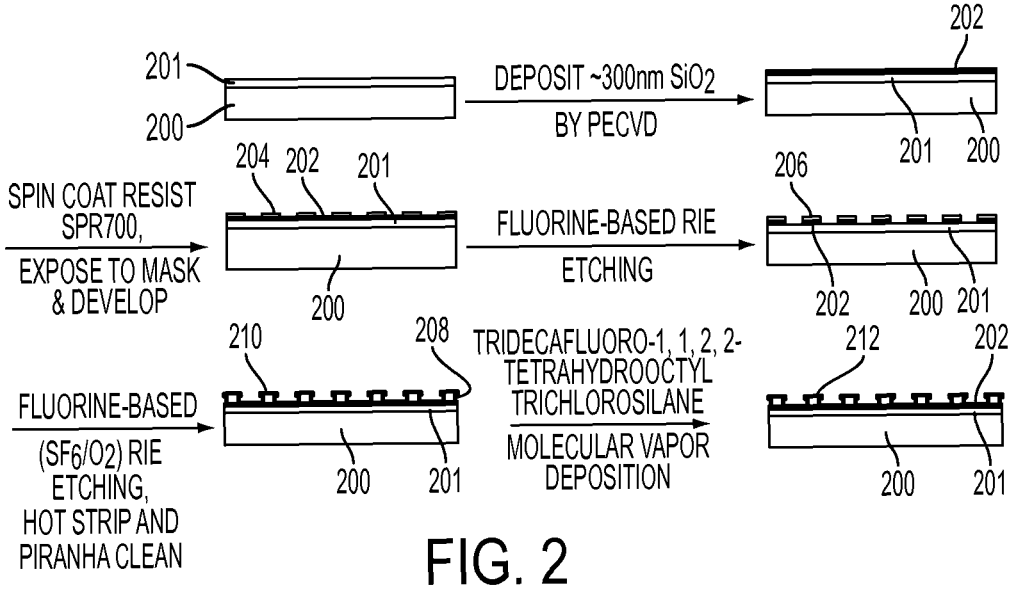
FIG. 2 is an illustration of a process scheme for preparing a fluorinated, textured surface on a flexible substrate wherein the textured surface comprises an array of pillars having overhang structures in accordance with the present disclosure.

Turning to FIG. 2, an embodiment of the present process comprises creating a textured surface on a flexible substrate comprising an array of pillars having overhang re-entrant structures. The process can comprise an analogous process using a combination of two fluorine etchings processes ($CH_3F/O_2$ and $SF_6/O_2$). Referring to FIG. 2, the process can comprise providing a flexible substrate 200 having disposed thereon a cleaned silicon layer, depositing an $SiO_2$ thin film 202 on the cleaned silicon layer 201, such as via sputtering or plasma enhanced chemical vapor deposition, applying a photo resist material 204 to the silicon oxide 202 coated silicon layer 201 on the flexible substrate 200, exposing and developing the photo resist material 204, such as with 5:1 photolithography using SPR™ 700-1.2 photo resist, using fluorine based reactive ion etching ($CH_3F/O_2$) to define a textured pattern in the $SiO_2$ layer comprising an array of pillars 206, using a second fluorine based ($SF_6/O_2$) reactive ion etching process, followed by hot stripping, and piranha cleaning to create the textured pillars 208 having over-hang re-entrant structures 210. The patterned array can then be coated with a conformal oleophobic coating 212 to provide a superoleophobic flexible device comprising a textured pattern of pillars having straight side walls and overhang re-entrant structures 210.

In a specific embodiment, the flexible device having superoleophobic surfaces herein are prepared using roll-to-roll web fabrication technology. This embodiment generally comprises creating the flexible device having a superoleophobic surface on a roll of flexible plastic. For example, a roll comprising a flexible substrate passes through a first station wherein a layer of amorphous silicon is deposited on the flexible substrate, such as by chemical vapor deposition or sputtering, followed by slot die coating with photoresist, followed by a second station comprising a masking and exposing/developing station, followed by an etching station, followed by a cleaning station. The textured, flexible substrate can then pass through a coating station where the textured, flexible substrate can be modified with a conformal oleophobic coating.

Figure 3:
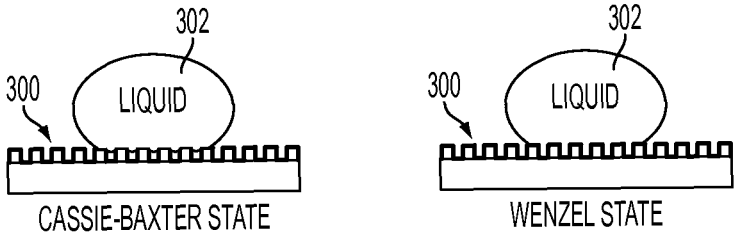
FIG. 3 is an illustration showing the states of liquid droplets on textured surfaces.

FIG. 3 summarizes the two states commonly used to describe the composite liquid-solid interface between liquid droplets on rough surfaces. In FIG. 3, a surface modified with silicon pillars 300 is shown wherein a liquid droplet 302 is shown in the Cassie-Baxter state and the Wenzel state. The static contact angles for the droplet 302 at the Cassie-Baxter state ($\theta_{CB}$) and the Wenzel state ($\theta_W$) are given by equations (1) and (2), respectively.

$$\cos\theta_{CB}=R_f f\cos\theta_\gamma+f-1 \quad (1)$$

$$\cos\theta_W=r\cos\theta_\gamma \quad (2)$$

where f is the area fraction of projected wet area, $R_f$ is the roughness ratio on the wet area and $R_f$ f is the solid area fraction, r is the roughness ratio, and $\theta_\gamma$ is the contact angle of the liquid droplet with a flat surface.

In the Cassie-Baxter state, the liquid droplet "sits" primarily on air with a very large contact angle ($\theta_{CB}$). According to the equation, liquid droplets will be in the Cassie-Baxter state if the liquid and the surface have a high degree of phobicity, for example, when $\theta_\gamma \geqq 90°$).

In embodiments herein, the devices having textured surfaces herein are superhydrophobic having very high water contact angles of greater than about 150° and low sliding angles of less than or equal to about 10°.

With respect to hydrocarbon-based liquid, for example, ink, as exemplified by hexadecane, in embodiments, the textured surfaces comprising an array of pillars having overhang re-entrant structures formed on the top surface of the pillars renders the surface "phobic" enough (that is, $\theta_\gamma$=73°) to result in the hexadecane droplet forming the Cassie-Baxter state at the liquid-solid interface of the textured, oleophobic surface. However, as the oleophobicity of the surface coating decrease, the textured surface actually transitions from the Cassie-Baxter state to the Wenzel sate. In embodiments herein, the combination of surface texture and chemical modification, for example, FOTS coating disposed on the textured surface, results in the textured surface becoming superoleophobic. On a flat surface, the oleophobic coating means the coating has a water contact angle of greater than about 100° and a hexadecane contact angle of greater than about 50°. In embodiments herein, oleophobic means $\theta_\gamma$=73°.

Superhydrophobic as used herein can be described as when a droplet of water or liquid forms a high contact angle with a surface, such as a contact angle of from about 130° to about 180° or a contact angle greater than about 150°.

Figure 4:
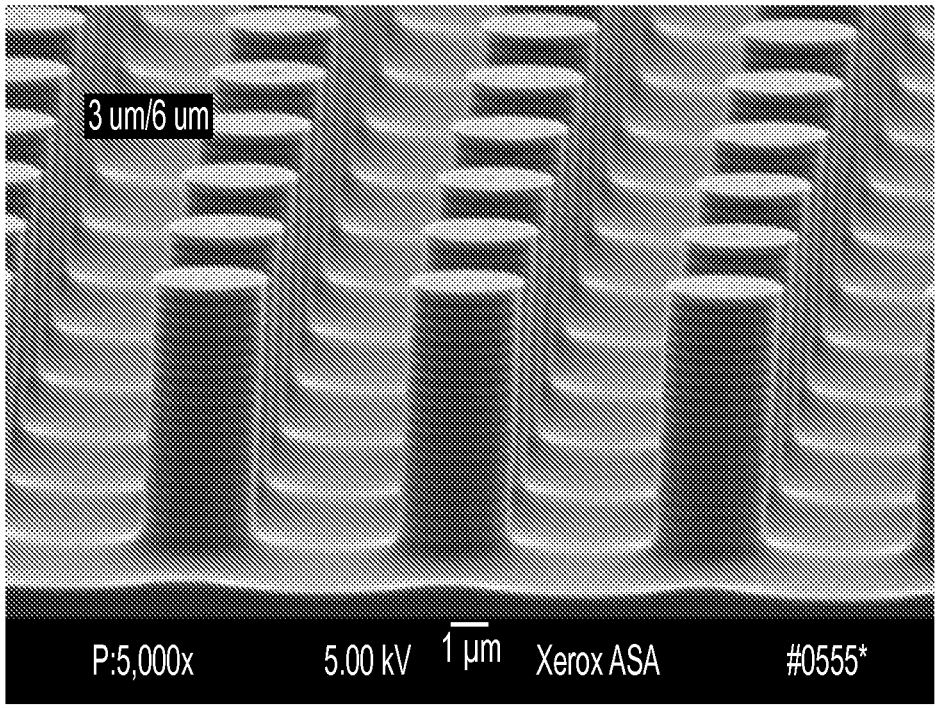
FIG. 4 is a micrograph of a fluorosilane-coated textured surface comprising an array of pillar structures having textured (wavy) sidewalls.
Figure 5:
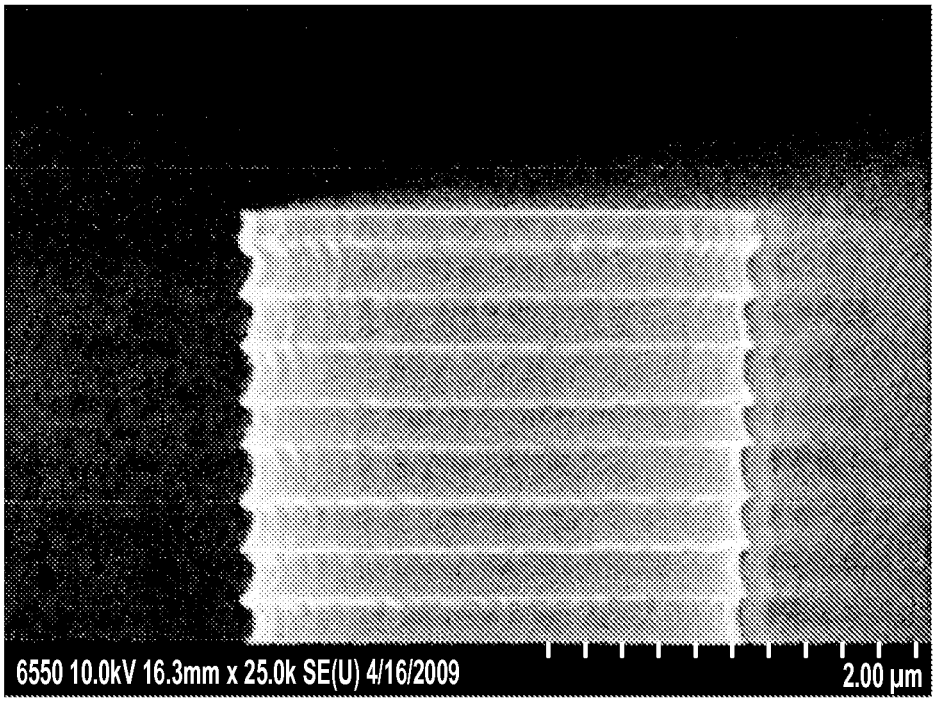
FIG. 5 is an enlarged view of a portion of the surface of FIG. 4 showing details of the wavy sidewall pillar structure.

FIG. 4 provides a micrograph of a fluorosilane-coated textured surface comprising an array of pillar structures having textured (wavy) sidewalls. FIG. 5 provides an enlarged view of a portion of the surface of FIG. 4, showing details of the wavy side wall pillar structure.

Figure 6:
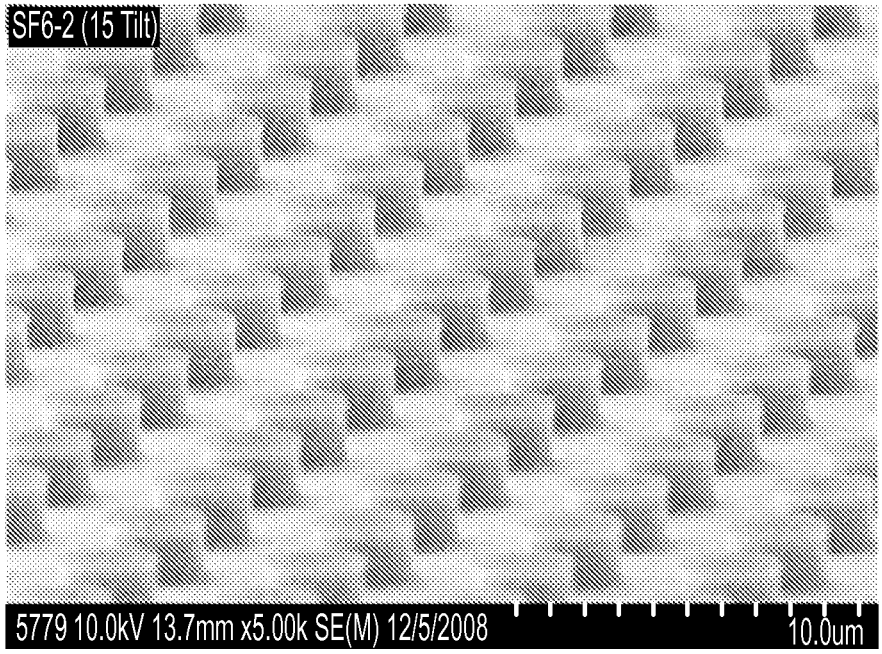
FIG. 6 is a micrograph of a fluorosilane-coated textured surface comprising an array of pillar structures having an overhang structure.
Figure 7:
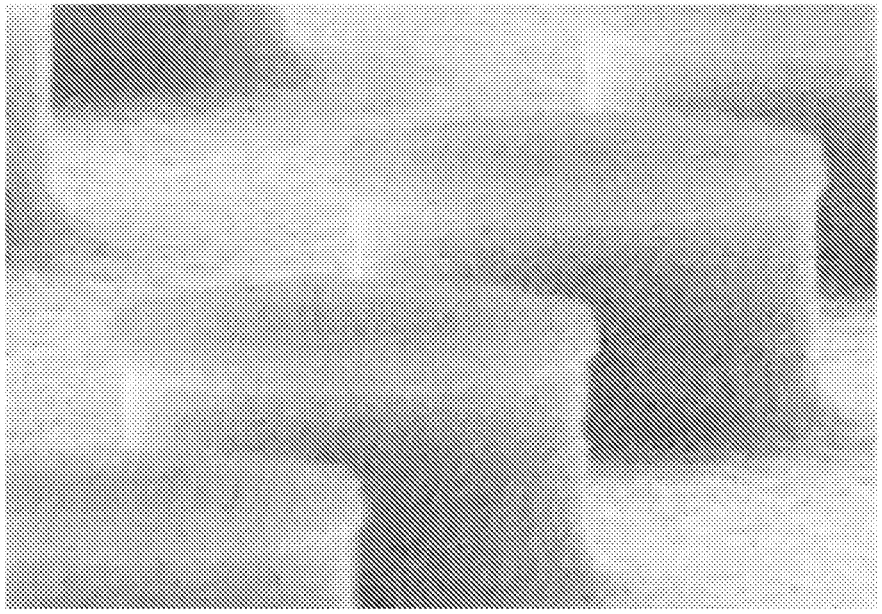
FIG. 7 is an enlarged view of a portion of the surface of FIG. 6 showing details of the over-hang feature.

FIG. 6 provides a micrograph of a fluorosilane-coated textured surface comprising an array of pillars having overhang re-entrant structures defined on the top of the pillars. FIG. 7 provides an enlarged view of a portion of the surface of FIG. 6 showing details of the overhang re-entrant feature.

The pillar array can have any suitable spacing or pillar density or solid area coverage. In embodiments, the array of pillars has a solid area coverage of from about 0.5% to about 40%, or from about 1% to about 20%. The pillar array can have any suitable spacing or pillar density. In a specific embodiment, the array of pillars has a pillar center-to-pillar center spacing of about 6 micrometers.

The pillar array can have any suitable shape. In embodiments, the array of pillars can be round, elliptical, square, rectangular, triangle, star-shaped or the like.

The pillar array can have any suitable diameter or equivalent diameter. In embodiments, the array of pillars can have diameter of from about 0.1 to about 10 micrometers, or from about 1 to about 5 micrometers.

The pillars can be defined at any suitable or desired height. In embodiments, the textured surface can comprise an array of pillars having a pillar height of from about 0.3 to about 10 micrometers, or form about 0.3 to about 4 micrometers, or from about 0.5 to about 3 micrometers.

Figure 8:
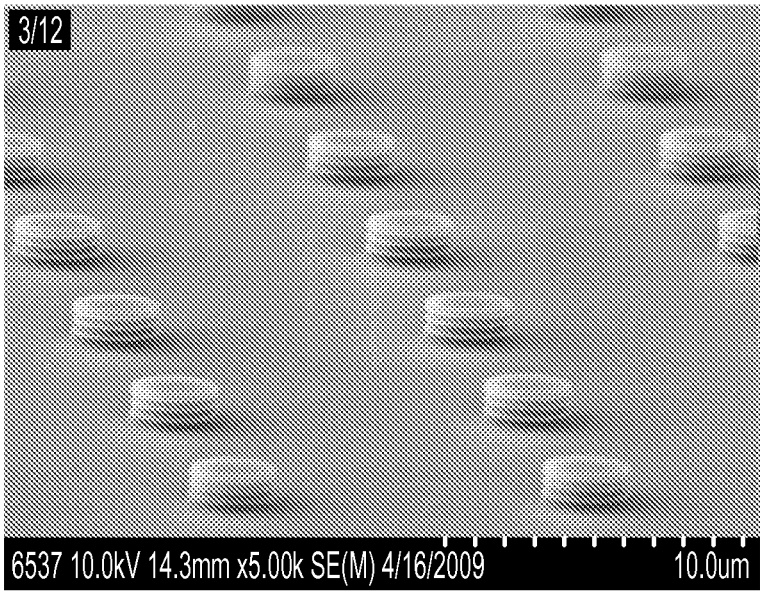
FIG. 8 is a micrograph of a superoleophobic textured surface comprising an array of pillars having a 1.1 micrometer pillar height.
Figure 9:
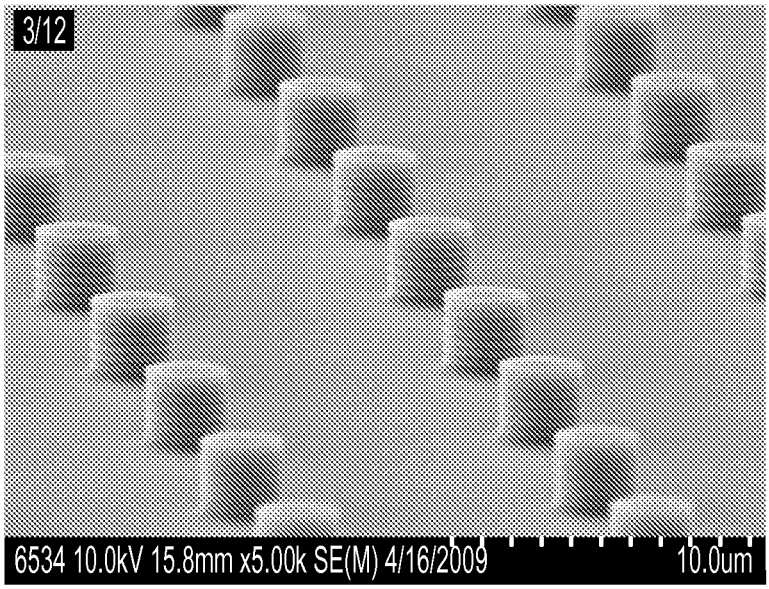
FIG. 9 is a micrograph of a superoleophobic textured surface comprising an array of pillars having a 3.0 micrometer pillar height.

In FIG. 8, a micrograph shows a superoleophobic textured surface comprising an array of pillars having a 1.1 micrometer pillar height. In FIG. 9, a micrograph shows a superoleophobic textured surface comprising an array of pillars having a 3.0 micrometer pillar height.

Figure 10:
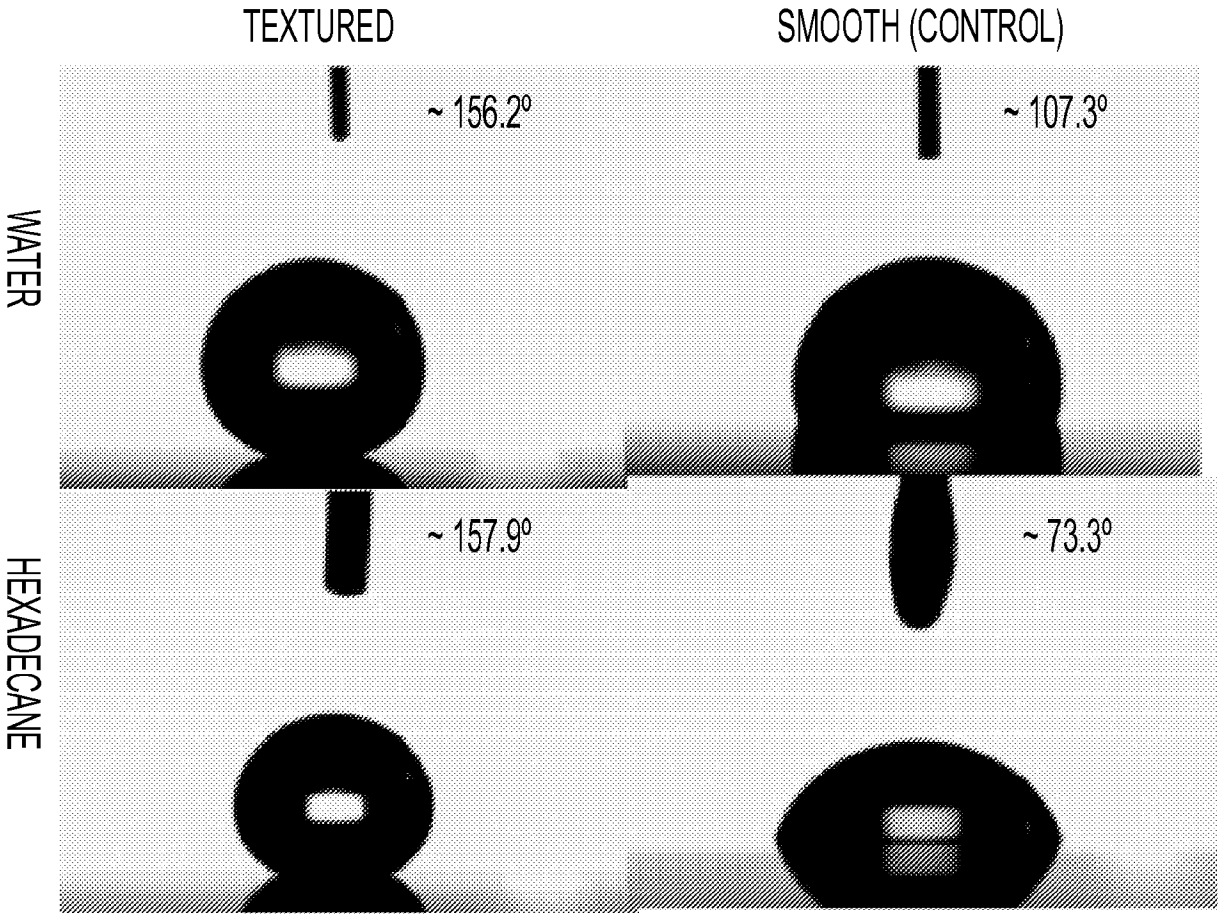
FIG. 10 is a photograph showing static contact angles for water and hexadecane on a fluorosilane-coated textured surface comprising an array of pillars having textured (wavy) sidewalls and on a fluorosilane-coated smooth surface.

The surface properties of the fluorinated textured surfaces were studied by determining both static and dynamic contact angle measurements. FIG. 10 is a set of photographs showing static contact angles for water and hexadecane on fluorosilane-coated textured surfaces prepared on a silicon wafer in accordance with procedures as described herein (but with a silicon wafer substituting for the flexible substrate) comprising an array of pillars having textured (wavy) sidewalls and on a flat FOTS surface for comparison. The contact angles for the smooth FOTS surface with water and hexadecane are 107° and 73°, respectively. In contrast, the textured FOTS surface exhibits extremely high repellency to both water and oil, with water and hexadecane contacts of 156° and 158°, respectively. While not wishing to be bound by theory, the inventors believe that the high contact angles observed for the FOTS textured surface with water and hexadecane is the result of the combination of surface texturing and fluorination. In specific embodiments, the textured devices herein comprise at least one of a wavy side wall feature or an overhang re-entrant structure at the top of the pillars to provide flexible superoleophobic devices.

Figure 11:
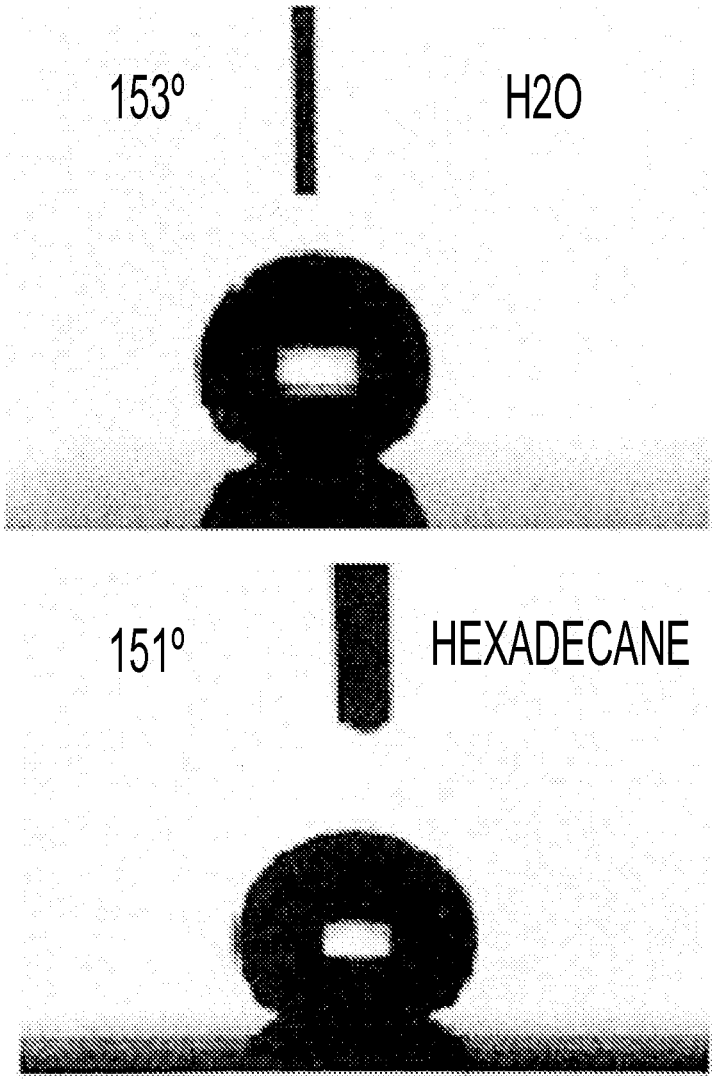
FIG. 11 is a photograph showing static contact angles for water and hexadecane on a fluorosilane-coated textured surface comprising an array of pillars having an over-hang structure.

FIG. 11 shows a pair of photographs illustrating static contact angles for water and hexadecane on a fluorosilane-coated textured surface comprising an array of pillars having a straight, smooth side wall and a 300 nanometer thick $SiO_2$ layer forming overhang re-entrant structures on the pillar tops. The contact angles for water and hexadecane are 153° and 151°, respectively. The sliding angles for water and hexadecane (not shown) are 14° and 20°, respectively. This illustrates that both liquids are in the Cassie-Baxter non-wetting state on the textured surface. While not wishing to be bound by theory, the inventors believe that the re-entrant structure on the top of the pillar is a significant driver for superoleophobicity.

The present inventors have demonstrated that superoleophobic surfaces (for example, wherein hexadecane droplets form a contact angle of greater than about 150° and a sliding angle of less than about 10° with the surface) can be fabricated by simple photolithography and surface modification techniques on a silicon wafer. The prepared superoleophobic surface is very "ink phobic" and has the surface properties very desirable for the front face of inkjet printheads, for example, high contact angle with ink for super de-wetting and high holding pressure and low sliding angle for self clean and easy clean. Generally, the greater the ink contact angle the better (higher) the holding pressure. Holding pressure measures the ability of the aperture plate to avoid ink weeping out of the nozzle opening when the pressure of the ink tank (reservoir) increases. Table 1 summarizes the contact angle data for a number of relevant surfaces with water, hexadecane, solid ink and ultraviolet curable gel ink. Sample 1 comprises a printhead as described in U. S. Pat. No. 5,867,189, which is hereby incorporated by reference herein in its entirety. Sample 2 is a smooth polytetrafluoroethylene surface, and Sample 3 is a superoleophobic surface prepared in accordance with the present disclosure having a textured surface comprising an array of 3 micrometer in diameter, 7 micrometer in height pillars with a center-to-center spacing of about 6 micrometers, and wavy side walls.

The superoleophobic surfaces described herein can be particularly suitable for use as front face materials for ink jet printheads. In embodiments, an ink jet printhead herein comprises a front face comprising a flexible substrate comprising a plastic film; a silicon layer disposed on the flexible substrate wherein the silicon layer comprises a textured pattern comprising an array of pillars; and a fluorosilane coating disposed on the textured surface. The contact angle and sliding angle are measured with 4 to 10 μl droplets of the testing liquids.

In embodiments, superoleophobic films prepared using photolithography via the roll-to-roll web manufacturing process and consisting of textured patterns of pillars on the flexible silicon film as described herein can be processed for use as ink jet printhead parts. Nozzles can then be created on the film, for example using laser ablation techniques or mechanical means (such as hole punching). Printhead size film can be cut, aligned and attached, such as glued, onto the nozzle front face plate for inkjet printhead applications. This textured nozzle front face will be superoleophobic and will overcome the wetting and drooling problems that can be problematic in certain current printheads. If desired, pillars can have a pillar height of 3 micrometers. Further, superoleophobicity can be maintained with pillar height as low as a micron. With reduced pillar height, the mechanical robustness of the shallow textured patterns increases. Very little to no surface damage is observed when manually rubbing these superoleophobic patterns.

TABLE 1

| | Water | | Hexadecane | | Solid Ink (~105° C.) | | UV ink (~75° C.) | |
|---|---|---|---|---|---|---|---|---|
| Example | Contact Angle | Sliding Angle | Contact Angle | Sliding Angle | Contact Angle | Sliding Angle | Contact Angle | Sliding Angle |
| 1 | ~130° | >90° | ~71° | ~64° | — | — | — | — |
| 2 | ~118° | ~64° | ~48° | ~31° | ~63° | >90° | ~58° | >90° |
| 3 | ~156° | ~10° | ~158° | ~10° | ~155° | 33°-58° | ~146° | ~10° |

Table 2 provides water and hexadecane contact angle data for a series of FOTS textured surfaces comprising an array of pillars about 3 micrometers in diameter having a center-to-center spacing of about 6 micrometers and a wavy sidewall structure.

TABLE 2

| Textured Surface Pillar Height (micrometers) | Testing Liquid | Static Contact Angle | Advancing Angle | Receding Angle | Sliding Angle |
|---|---|---|---|---|---|
| 7 | Water | 156.2° | 160.8° | 151.8° | 3.4° |
| | Hexadecane | 154.3° | 162.3° | 144.7° | 3.7° |
| 3 | Water | 153.7° | 160.9° | 151.3° | 4.0° |
| | Hexadecane | 153.4° | 160.5° | 140.1° | 4.3° |
| 1.5 | Water | 154.3° | 162.0° | 151.0° | 3.6° |
| | Hexadecane | 152.6° | 162.1° | 142.4° | 4.5° |
| 1.1 | Water | 154.7° | 160.1° | 152.5° | 3.8° |
| | Hexadecane | 153.1° | 160.4° | 140.3° | 4.8° |
| 0.8 | Water | 154.9° | — | — | — |
| | | 107.7° | | | |
| | Hexadecane | 154.3° | 160.7° | 140.2° | 5.0° |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A process for preparing a flexible device having a superoleophobic surface comprising:

providing a flexible substrate;

disposing a silicon layer on the flexible substrate;

using photolithography to create a textured pattern in the silicon layer on the substrate wherein the textured pattern comprises an array of pillars the array of pillars comprising pillars having a height of about 0.3 to about 4 micrometers; and chemically modifying the textured surface by disposing a conformal oleophobic coating thereon;

to provide a flexible device having a superoleophobic surface.

2. The process of claim 1, wherein the flexible substrate comprises a plastic film.

3. The process of claim 1, wherein the flexible substrate comprises polyimide film, polyethylene naphthalate film, polyethylene terephthalate film, polyethersulfone film, or polyetherimide film.

4. The process of claim 1, wherein the silicon layer comprises amorphous silicon.

5. The process of claim 1, wherein the silicon layer comprises amorphous silicon disposed at a thickness of from about 1 to about 5 micrometers.

6. The process of claim 1, wherein chemically modifying the textured substrate comprises chemical modification by self-assembling a fluorosilane coating onto the textured surface conformally via a molecular vapor deposition technique, a chemical vapor deposition technique, or a solution self assembly technique.

7. The process of claim 1, wherein a precursor for the oleophobic conformal coating is tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof.

8. The process of claim 1, further comprising:

using roll-to-roll web fabrication technology to prepare the flexible device having a superoleophobic surface.

9. The process of claim 1, wherein the photolithography comprises using multiple etching cycles to create a vertical etch wherein each of the multiple etching cycles comprises a) depositing a protective passivation layer, b) etching to remove the passivation layer where desired, and c) etching the silicon isotropically; and d) repeating steps a) through c) until a desirable pillar height is obtained.

10. The process of claim 1, wherein the pillars are round, elliptical, square, rectangular, triangle, or star-shaped.

11. The process of claim 1, wherein the array of pillars has a solid area coverage of from about 0.5% to about 40%.

12. The process of claim 1, wherein the pillars have an over-hang re-entrant structure.

13. The process of claim 1, wherein the pillars have a textured sidewall comprises a plurality of waves, and wherein the size of each wave of the wavy sidewall is from about 100 nanometers to about 1,000 nanometers.

14. A flexible device having a superoleophobic surface comprising:

a flexible substrate comprising a plastic film;

a silicon layer disposed on the flexible substrate wherein the silicon layer comprises a textured pattern comprising an array of pillars; and a conformal oleophobic coating disposed on the textured surface;

wherein array of pillars comprises having a height of about 0.3 to about 4 micrmeters.

15. The flexible device having a superoleophobic surface of claim 14, wherein the pillars have an over-hang re-entrant structure.

16. The flexible device having a superoleophobic surface of claim 14, wherein the pillars have a textured sidewall comprising a plurality of waves, and wherein the size of each wave of the textured sidewall is from about 100 nanometers to about 1,000 nanometers.

17. The flexible device having a superoleophobic surface of claim 14, wherein superoleophobic surface comprises a surface wherein hexadecane has a contact angle with the surface of from greater than about 130° to about 175°.

18. The flexible device having a superoleophobic surface of claim 14, wherein the superoleophobic surface comprises a surface wherein hexadecane has a sliding angle with the surface of less than about 25°.

19. An ink jet printhead comprising:

a front face comprising a flexible substrate comprising a plastic film; a silicon layer disposed on the flexible substrate wherein the silicon layer comprises a textured pattern comprising an array of pillars, the array of pillars comprising pillars having a height of about 0.3 to about 4 micrometers; and a conformal oleophobic coating disposed on the textured surface.

* * * * *